United States Patent [19]

Forrester

[11] 4,157,688

[45] Jun. 12, 1979

[54] RATIO INDICATOR FOR RUFFLING APPARATUS

[75] Inventor: Harold C. Forrester, Louisville, Ky.

[73] Assignee: Louisville Bedding Company, Louisville, Ky.

[21] Appl. No.: 866,701

[22] Filed: Jan. 3, 1978

[51] Int. Cl.[2] ..... D05B 35/08

[52] U.S. Cl. ..... 112/132; 112/270

[58] Field of Search ..... 112/132, 133, 134, 135, 112/270; 223/28

[56] References Cited

U.S. PATENT DOCUMENTS

| | | | |
|---|---|---|---|
| 1,440,460 | 1/1923 | Hannsz | 112/270 X |
| 1,597,077 | 8/1926 | Keywood | 112/270 X |
| 2,803,207 | 8/1957 | Sotzky | 112/134 X |
| 3,000,332 | 9/1961 | Sigoda | 112/132 |

*Primary Examiner*—H. Hampton Hunter

*Attorney, Agent, or Firm*—Maurice L. Miller, Jr.

[57] ABSTRACT

A conventional ruffling machine, which contemporaneously receives a forwardly moving strip of base material (a.k.a. dust ruffle platform) and an overlying flat faster moving strip of stock material to be ruffled, whch progressively forms a succession of ruffles in said ruffling stock material along a given line and which immediately sews the ruffles to the base material, is provided with one or more (length or speed) measuring rolls engaged with and rotated by said fast moving ruffling material and an indicator actuatable by at least one roll and operative, when actuated, to indicate the actual (length or speed) ratio, between a given length of ruffling material fed rapidly to said machine and the corresponding smaller length of sewn ruffled material delivered more slowly from said machine, and its relationship to a desired ratio.

15 Claims, 7 Drawing Figures

RATIO INDICATOR FOR RUFFLING APPARATUS

CROSS REFERENCES TO RELATED APPLICATIONS

A related application has not been filed.

BACKGROUND OF THE INVENTION

1. Field of the Invention

This invention relates to the art of ruffling, pleating or gathering strip material.

2. Description of the Prior Art

There are a great many textile items that are ruffled, etc., sometimes for decorative purposes, other times to decrease the amount of material along a certain contour while leaving the major portion of the material unpleated so that it may drape attractively. Normally, ruffling is achieved by means of an oscillating tucking blade, which is adjustable to vary the size or amplitude of each ruffle. This tucking blade is generally mounted on the receiving side of the sewing machine's presser foot so that each individual tuck, taken or formed in that flat ruffling material entering the sewing machine, is in position to be sewn immediately following the completion of the individual tucking operation, which formed it.

Under proper operating conditions, ruffles of a desired size will be formed and sewn and a desired ratio, between a given length of rapidly moving strip stock material fed to the sewing machine and the correspondingly smaller length of "sewn ruffled material" (a.k.a. dust or bed ruffle) delivered more slowly from the machine, will be maintained. However, if the individual ruffles are smaller than desired, the designer's objective is not attained. If they are larger than desired, excess ruffling stock material is consumed, which is undesirable to one party or another because of the increased cost.

In some cases, a 1st party, who is equipped to do the ruffling, may be employed to do so at a given price by a 2nd party who supplies both materials under an agreement requiring a fixed amount of ruffling material to be consumed at a ratio of, say, 1.5 (i.e., 1.5 ruffling to 1.0 base). If the 2nd party specifies a 1.5 ratio and, at no cost to the ruffler, supplies 15,000 yards of material to be ruffled and 10,000 yards of base or platform material, the 1st party in ruffling the 15,000 yards of ruffle material and sewing it to the 10,000 yards of base or platform material, must maintain the specified ratio of 1.5. However, if he erroneously maintains a ratio of 1.7, he will sew all 15,000 yards of ruffling material to approximately 8,820 yards of base or platform material and, for the same erroneously high ratio, he will need 2,000 additional yards of ruffling material for the remaining 1180 yards of base platform material. Needless to say, the cost of this extra 2,000 yards must be borne by the ruffler at a corresponding loss to him.

In the prior patented art, the Sotzky U.S. Pat. No. 2,803,207 discloses an oscillating tucking blade which is adjustable to vary the size or amplitude of each ruffle; and the U.S. Sigoda U.S. Pat. No. 3,000,332 discloses a multiple ruffling machine which, in each of several ruffling lines, receives lace strips under varying tensions but operates to meter out precise lengths thereof to be ruffled. In other words, it keeps the metered amount for each ruffle at a constant value so as to maintain the same ratio in ruffling materials supplied under non-uniform tensions. Indicating means, enabling an erroneously high ratio to be quickly determined and corrected, is not disclosed in this prior art.

SUMMARY OF THE INVENTION

Objects of the Invention

The principal object of the present invention is to provide a means for affording an early indication of the relationship between the actual ratio and the desired ratio so that an erroneous ratio can be readily discovered and corrected.

Another important object is to provide such an indicating means which is simply constructed, inexpensively manufactured and installed, effective in operation and operative over substantial periods without requiring anything more than nominal maintenance.

Statement of the Invention

The objects of my invention may be achieved by placing roll means in engagement with the ruffling material moving through the machine and by providing indicator means actuatable by the roll means and operative, when actuated, to indicate either: the actual ratio, between the flat strip ruffling stock material fed into the machine and the ruffled material delivered from the machine; or its relationship to the desired ratio.

BRIEF DESCRIPTION OF THE DRAWINGS

The invention is illustrated in the accompanying drawings wherein.

DESCRIPTION OF THE PREFERRED EMBODIMENT

FIGS. 1-3

Conventional Equipment

Figure 1:
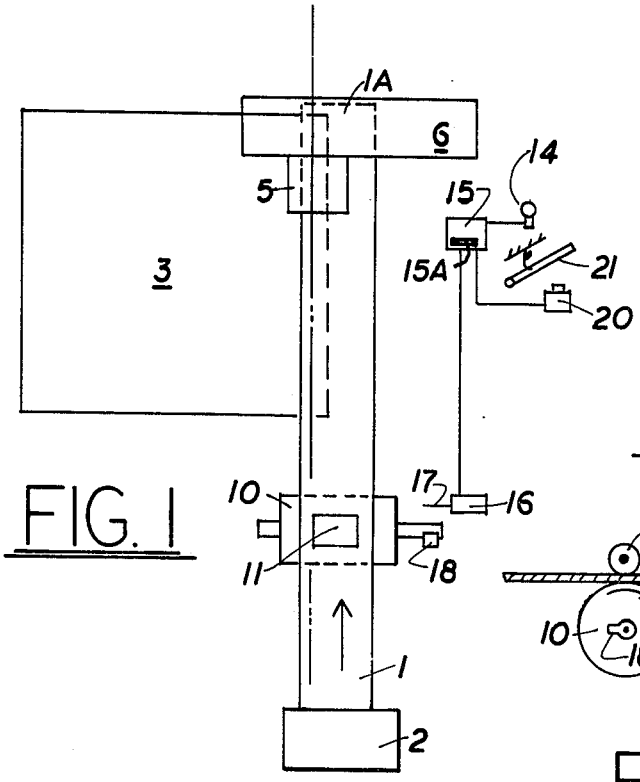
FIG. 1 is a somewhat schematic plan view of a sewing apparatus embodying the present invention.
Figure 2:
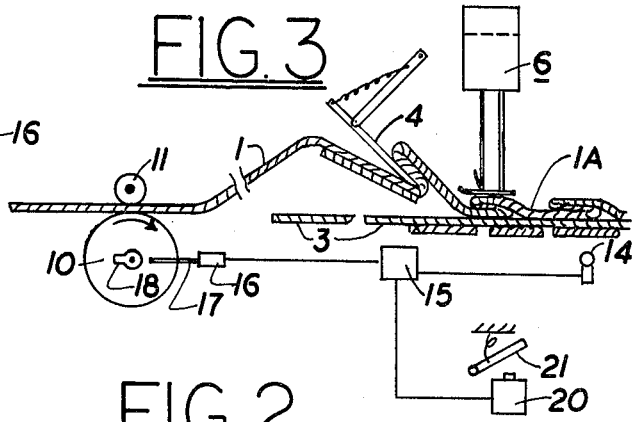
FIG. 2 is a somewhat schematic end view, partly in section, of the apparatus shown in FIG. 1.

FIGS. 1 and 2 show the flap strip stock material 1, to be ruffled, fed from a suitable source 2 over one margin of the platform or panel 3 for a dust ruffle or bed ruffle. The corresponding margin of the ruffling stock strip 1 is progressively ruffled by the oscillating tucking blade 4 of a ruffle-forming attachment 5 of the sewing machine 6 and immediately sewn by machine 6 to said platform or panel 3. As the operation proceeds and the corners of the platform panel 3 pass the sewing needle, the platform panel is turned 90° counterclockwise. The straight margins of the platform panel 3 are fed through the sewing machine 6 at one more or less constant rate while the unruffled stock strip 1 is fed into the machine 6 at the more or less constant higher rate required to accommodate the ruffling operation. Obviously, both are delivered by the machine at the same platform rate. It will be understood that the sewing machine 6 determines the platform rate at which the straight margins of the panel 3 are fed through it while the stroke of the oscillating tucking blade 4 determines the higher rate at which the unruffled stock strip 1 is fed into the sewing machine.

Conventional Dust or Bed Ruffle

Figure 3:
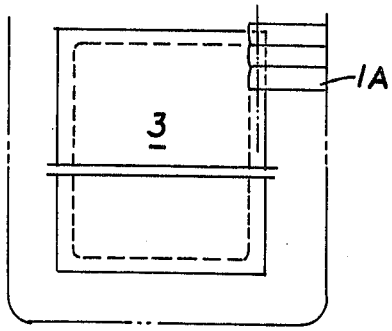
FIG. 3 is a plan view of an end product, such as a dust or bed ruffle, having a fragmentary portion of ruffled material secured to its periphery.

FIG. 3 shows the dust or bed ruffle product produced by the foregoing operation except that only a fragmentary portion of the ruffled strip 1A is actually indicated on the panel 3. To promote clarity by concrete example, we shall assume the platform panel 3 of FIG. 3 is dimensioned 48" wide by 72" long, i.e., 4'×6'. With these dimensions, the finished dust or bed ruffle product will have a ruffled strip 1A extending along and sewn to the sides and bottom of the platform panel or to 16' of its entire 20' periphery. We shall also assume that the desired ratio of the length of the ruffling stock strip 1 to the 16' length of the ruffled strip 1A is 1.5 to 1; hence, for each platform or panel 3, a length of flat strip stock material 1 theoretically equal to 24' must be provided and then ruffled and sewn to a ruffled length actually equal to 16'. Normally this 24' length will vary somewhat under the best of operating conditions.

Conventional Practice

In conventional practice, the stroke of the tucking blade 4 is manually adjusted to produce ruffles of the size or amplitude desired, this size being such as will result in the 1.5 ratio, which is assumed to be the desired ratio. When this adjustment has been made, the operator proceeds through the requisite length of ruffle stock 1 and the entire supply of platform panels 3. If the adjustment is correct and other factors do not interfere, these supplies of strip material 1 and of panels 3 required for this particular operation will both be more or less used up at the same time at the end of the run. If the actual ratio is too low, the supply of platform panels 3 will be exhausted before the length of the ruffling stock strip 1 required by the desired ratio is used up and all of the finished dust or bed ruffles will have ruffles of a size smaller than desired. On the other hand, if the actual ratio is too high, the length of ruffling stock strip 1 required by the desired ratio will be used up before the platform panels 3 are exhausted while the size of the ruffles on the dust or bed ruffle will be larger than the desired size.

While some variations from desired results are inherently encountered at the end of each conventionally operated run, such inherent variations usually are not seriously objectionable. From time to time, however, an operator may encounter a substantial variation. If it results from an erroneously high ratio, it is particularly objectionable because it may result in the rejection of the entire run of end products, it will result in an objectionable increase in the manufacturing costs of the entire run and it may result in some other dissatisfaction.

New Ratio Indicator

In accordance with the present invention, an apparatus is provided which enables an operator to determine what the actual ratio is in a given operation and this determination necessarily informs the operator whether or not the desired ratio is being maintained. Such apparatus, which is illustrated in FIGS. 1–2, specifically comprises: a length measuring roll means; means recording or counting the revolutions of said roll; signal means for indicating a set number of revolutions; and means for resetting the recorder back to its starting point.

Length Measuring Roll

The length measuring roll means comprises a length measuring roll 10, which is rotated by the strip 1. A presser roll 11 presses the strip 1 against the periphery of the measuring roll 10. One full revolution of the measuring roll 10 (or a given fraction thereof) corresponds to, and is produced by, one unit length of strip material 1. We assume that one unit length of strip material 1 is 1.00'; and that the measuring roll 10 has a circumference of 12" or 1.00' so that it will undergo one full revolution for each 1.00' length of flat ruffle strip stock material passing over it or 10 revolutions for each 10.0' of ruffle strip stock.

Recording or Counting Means

The recording means, which may be of any suitable type, comprises: a revolution counter 15 operative, when actuated, to record, register or count one revolution of the measuring roll 10 on a digital readout 15A; and means for actuating the recorder or counter once during each revolution of roll 10. The actuating means comprises an electrical switch 16 having an operating arm 17 positioned in the path of cam 18 on the shaft of roll 10 so that it is operated once during each revolution of roll 10. In other words, during each revolution of roll 10, cam 18 operates switch-operating arm 17 to close switch 16 and thereby energize revolution counter 15 causing it to record one revolution. The revolution counter 15 preferably has a digital readout 15A so that the number of consecutive revolutions may be read at any desired time.

Signal Means

The recorder is also provided with a signal lamp 14 which, (in any well known way not shown) is arranged to be energized by the counter when the last of a selected series of revolutions is counted or recorded by the counter 15. For example, the counter 15 may be arranged to energize lamp 14 when the counter is actuated at the end of a selected revolution of the measuring roll 10, say, for example, the 24th revolution thereof, which corresponds to the passage of 24' of flat unruffled strip 1 when a 1' measuring roll 10 is used. Needless to say, this arrangement may be changed to energize lamp 14 at the end of some other selected revolution.

Reset Means

The revolution counter 15 is of a well known type in which its digital readout can be reset back to zero from any of its digital readouts through a reset switch 20 under the control of the operator who operates reset member 21 which may be a foot pedal, a hand-operated pushbutton or the like.

Operation of FIGS. 1–2

As the outset, we assume that the length measuring roll 10 has a 1' circumference; that the dimensions of the platform panel 3, which is to be ruffled, approximate 4'×6' so that its opposite 6' side peripheries and its 4' bottom periphery aggregate 16'; and that flat strip lengths, each approximating 24', are required for ruffling the 4'×6' panels at a 1.5 ratio.

With these assumptions, a mechanic will not only adjust the tucking blade to provide ruffles of the requisite amplitude but also set the revolution counter to be energized at the same time that the revolution counter records the 24th length measuring revolution which is also a record of the 24th foot of strip 1.

Now, with these assumptions, the operator proceeds to direct the top end of one side margin of the platform panel 3 into operative position relative to the sewing machine 6. Contemporaneously, the operator will direct the ruffling strip 1 into operative position in relation to the tucking apparatus 5.

During the operation, a succession of ruffles will be formed by tucking blade 4 and the same progressively sewn to said side margin of platform panel 3 by the sewing machine 6. At the bottom end of the starting side margin of platform panel 3, the operator will manually form a large tuck and sew it to the bottom corner of platform panel 3 while turning that panel CCW (counterclockwise) around the corner.

After the bottom edge or margin has been ruffled, the next bottom corner ruffling and turning operation is performed. Finally, the operator ruffles the opposite or remaining side edge of the platform panel 3. All of these straight margin and corner operations are accomplished without the operator necessarily paying any attention to the revolution counter 15 or the lamp 14.

When the ruffling operation on platform panel 3 is completed, the recorder should have a reading indicating that 23, 24 or 25′ of ruffling strip 1 has been sewn to the completed platform panel 3. If the recorder reads 23′, the signal lamp 14 will not be energized. If the recorder reads 24′, the signal lamp 14 will be energized. Finally, if the recorder reads 25′, the signal lamp 14 will be energized at 24′ and remain energized at 25′.

The variation, between 23 and 25′, is something customarily encountered in normal operation. It may be due to one or more of the following things, viz: (1) the strip 1 material stretches nonuniformly as it is fed into the machine; (2) the finish on that material may be such as to cause the tucking blade to slip to different degrees as it creates successive tucks; or (3) the operator may use different amounts of material in manually forming each corner tuck. Variations of this type are inherent and normally unimportant; hence, when the operator has completed the ruffling of a platform panel 3, she simply strikes switch operating member 21 to reset counter 15 to zero and then starts ruffling the next platform panel 3.

Should the revolution counter 15 read slightly less than 23′ on the completion of several panels, the operator ordinarily will continue the operation unchanged because the slightly smaller size of ruffles produced is not necessarily important to anyone concerned. If the end reading of the revolution counter 15 is substantially less than 23′, the operator may then call the mechanic in charge and advise him of the order of magnitudes of the deficient readings she has observed so that he may re-adjust the tucking blade stroke should he deem it necessary.

On the other hand, if the revolution counter consistently reads more than 25′ at the completion of several successive panels, the visible signal 14 (or an audible signal or both) will be energized on the 24th revolution. Now the operator will again call the mechanic and he will normally re-adjust the machine to reduce the size or amplitude of the successive ruffles and thus sew a smaller length of strip to a platform panel 3.

Before passing, it may be noted that, since the apparatus of FIGS. 1–2 shows the actual length of flat strip stock material used on a known length of platform panel 3, such apparatus shows the actual ratio not only between the incoming stock strip material 1 and the corresponding incoming margin of the panel 3 but also between the incoming unruffled strip 1 and the outgoing ruffled strip 1A.

Also, it will be observed that the machine of FIGS. 1–2 operates on a succession of assumed 4′×6′ aprons, each to be ruffled on a 3-sided periphery of a known 16′ length. The FIGS. 4–5 machines may also operate on a succession of equal lengths to known value. The FIGS. 1–2 machines and the FIGS. 4–5 modifications may operate on relatively elongate strips, all of which collectively constitute an entire run and each of which can later be cut to desired lengths.

FIGS. 4–5

Figure 4:
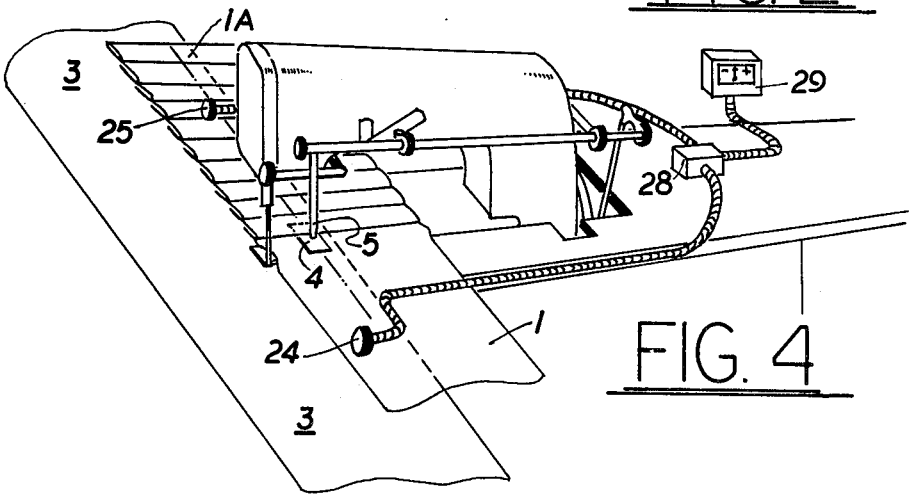
FIG. 4 is a schematic perspective view of a modification of the invention.
Figure 4A:
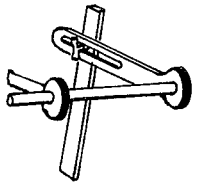
FIG. 4A is a fragmentary view of prior art means used in FIG. 4 for adjusting the tucking blade stroke.
Figure 4B:
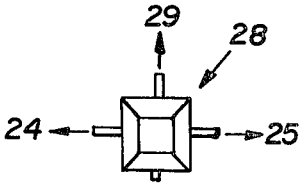
FIG. 4B is a somewhat schematic view of a conventional planet gear differential which may be employed as element 28 of FIG. 4.

FIGS. 4, 4A and 4B, show a modification also comprising: strip-driven means; and indicator means. The strip-driven means is in the form of a pair of strip-driven rolls 24, 25 wherein roll 24 is driven by the incoming flat stock strip material 1 while roll 25 is similarly driven by the outgoing ruffled strip material. The indicator means includes: a sensing means in the form of a planet gear differential indicated by numeral 28 and conventionally composed of two ring gears and an interposed pinion gear so connected that roll 24 drives one ring gear at a speed higher than the speed at which roll 25 drives the other ring gear. The two ring gears of the planet differential 28 conventionally drive the pinion gear at a rate of speed ranging from a range of minus values through zero to a range of plus values or from a range of low values through a desired value to a range of plus values and reflecting the difference, if any, in the speed of the two ring gears and the direction of that difference. This difference is indicated by a speedometer 29 which is operatively connected to the pinion of the planet differential 28 and which is provided with a scale that may be calibrated either in terms of actual speed differential or in terms of actual speed ratio.

Figure 5:
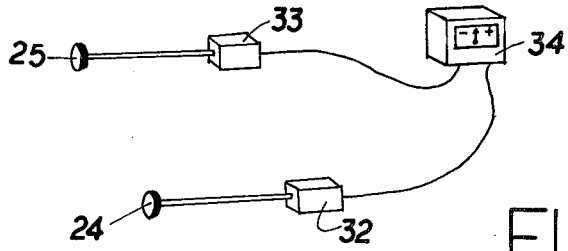
FIG. 5 is a view of another modification.

FIG. 5 shows a modification wherein the planet differential 28 and speedometer 29 of FIG. 4 are replaced by generators 32, 33 and voltmeter 34 of FIG. 5. Thus, in FIG. 5, the operation proceeds as follows: strip driven roll 24 drives electrical generator 32 at the speed of unruffled strip 1; strip-driven roll 25 drives generator 33 at the lower speed of ruffled strip 1A; and both generators are connected to voltmeter 34 wherein they oppose or buck each other. With a correct setting or adjustment of tucking blade 4, the voltmeter scale will point either to a zero or neutral scale value, preferably corresponding to the numerical scale value of the desired ratio. If the adjustment is incorrect, it will point to the low side of the desired ratio when the incoming high speed is too low or to the high side when the incoming high speed is too high.

One advantage of the modifications of FIGS. 4–5 is that the speedometer in one case, the voltmeter in the other case enables the operator to keep a continuous accurate visible check on the actual ratio at which the machine operates. Consequently, it is a relatively easy matter to change the stroke of blade 4 to adjust the ratio to the desired value at any time that it is desirable or necessary during a given run and from time to time during subsequent runs; hence, it is easy to maintain the correct ratio.

Miscellaneous

The present invention also contemplates the idea of replacing the planet differential and speedometer of FIG. 4 or the generators of FIG. 5, with a pair of low speed tachometers, respectively driven by rolls 24, 25 to enable the operator visually to determine the difference between tachometer readings and thus more or less continuously gage the accuracy of the tucking blade adjustment. This modification, which omits the voltmeter of FIG. 5, is so simple that illustration is deemed unnecessary.

While I have described my invention in connection with a ruffling operation on a base strip, usually called a platform or a platform strip, it will be obvious that it can be used to ruffle a ruffling strip alone (i.e., without a base strip) and that it may be used in pleating and gathering operations. Also, while I have shown the ruffling strip 1 on the top side of the platform strip 3, it may be on the bottom side thereof or on both sides in accordance with conventional practice.

I have obtained good results with the arrangement of FIGS. 1–2 under conditions wherein: the ratio is 1.5; and the incoming and outgoing speeds of the unruffled stock and ruffled product strips approximate 75 fpm (feet per minute) and 50 fpm. In a gathering operation, I contemplate an increase in these incoming and outgoing speeds up to as much as 120 fpm and 80 fpm more or less at the same 1.5 ratio. Of course, other ratios may be used where desired.

Also, in place of plus and minus values on the meters 29 and 34, a scale of actual ratio values may be employed.

The term "ruffling" is and has been used in this application in its broad generic sense to include not only ruffles but also pleats, gathers and the like.

It will be understood: that the indicator means 15 of FIGS. 1–2, 29 of FIG. 4, and 34 of FIG. 5, is, in each case, actuatable by material driven means, in the form of at least one length measuring roll 10 or 25, and operative, when actuated during a ruffling operation, to indicate the relationship between the actual ratio and the desired ratio. The ratio indicator means of FIGS. 1–2 includes sensory signaling means and recording means. The sensory signaling means (lamp 14) is operative, when energized, to provide a sensory signal, visible or audible or both. The recording means (revolution counter 15) provides a running readout of the measured length in terms of revolutions of the length measuring roll 10 and responds to the measurement of a particular length of ruffling material, to actuate the sensory signaling means. The counter is actuated at the end of each full length measuring revolution but it may, of course, be actuated by fractional roll revolutions. The operator actuates the reset means 20–21 to reset the counter when desired.

In FIGS. 4–5, the speedometer 29 of FIG. 4 and the voltmeter 34 of FIG. 5 provide a running readout of the actual ratio.

While the detection of erroneously low ratios are of interest, the detection of erroneously high ratios is vitally important.

Having described my invention, I claim:

1. In a ruffling machine for receiving ruffling, pleating, gathering or like stock material and for forming a succession of ruffles in said stock material, progressively sewing said ruffles as they are formed and then delivering the ruffled material, a ratio indicator comprising:

A. material driven means engaged with and driven by said ruffling material; and

B. indicator means actuatable by said driven means and operative, when actuated during a ruffling operation, to indicate the relationship of the actual ratio, between a given length of incoming stock material and the corresponding smaller length of outgoing ruffled material, to a desired ratio therebetween.

2. The ratio indicator of claim 1 wherein:

A. said material driven means is in the form of at least one length measuring roll.

3. The ratio indicator of claim 1 wherein said indicator means includes:

A. sensory signaling means operative, when energized, to provide a sensory signal; and B. recording means, responsive to the measurement of a particular length of ruffling material, to actuate the sensory signaling means.

4. The ratio indicator of claim 1 wherein

A. said material driven means is in the form of at least one length measuring roll; and B. said indicator means includes 1. a revolution counter and
2. means for actuating said counter at least once during each revolution of said length measuring wheel.

5. The indicator of claim 4 wherein:

A. said counter is operative, when actuated a number of times, corresponding to the feed of a given measured length of said flat stock ruffling material, to indicate the relationship of the actual ratio to said desired ratio.

6. The ratio indicator of claim 5 including:

A. operator actuatable means for resetting said counter to ready it for the next length measuring operation.

7. The ratio indicator of claim 6 including:

A. sensory signaling means operative, when energized, to provide a sensory signal; and B. said counter being operative to energize said signaling means upon the completion of a selected number of measuring wheel revolutions.

8. The ratio indicator of claim 3 wherein:

A. said material driven means comprises 1. a rotary length measuring roll, one full revolution of which corresponds to and is produced by engagement with one unit length of flat material being fed for ruffling purposes; and B. said indicator means includes 1. a revolution counter operative, when actuated, to record one revolution of said length measuring wheel on a digital readout, and 2. means for actuating the counter once during each revolution of said wheel, a. said counter being operative, when actuated a given number of times, to indicate the relationship of the actual ratio to said desired ratio.

9. The ratio indicator of claim 8 including:

A. operator actuatable means for resetting said counter to ready it for the next length measuring operation.

10. The ratio indicator of claim 7 including:

A. signaling means operative, when energized, to provide a sensory signal indicating a given number of revolutions; and B. said counter being operative to energize said signaling means upon the completion of a selected number of measuring wheel revolutions.

11. The ratio indicator of claim 3 wherein:

A. said material driven means includes a pair of rolls, one engaging the flat ruffling stock material and the other engaging the ruffled material.

12. The ratio indicator of claim 11 wherein said indicator means includes:

A. a pair of roll-actuated means, one for each roll of said pair.

13. The ratio indicator of claim 12 wherein said indicator means includes:

A. means placing said roll actuated means in opposition to each other and indicating the difference between the speeds thereof.

14. The ratio indicator of claim 13 wherein said opposition placing means includes:

A. a planet differential having 1. one ring gear connected to be driven by one roll,
2. a second ring gear connected to be driven by the other roll, and
3. a pinion gear connected to energize said signaling means in accordance with the differential between the speeds of said ring gears.

15. The ratio indicator of claim 11 wherein said means includes:

A. a pair of electrical generators, one for each roll of said pair, each generator being driven by its roll;

B. an electrical meter operative, when energized in opposite directions by said generators, to indicate the relationship of said actual ratio to said desired ratio; and C. means for energizing said meter in opposite directions including 1. means connecting one generator to said meter for energizing it in one direction, and
2. means connecting the other generator to said meter for energizing it in the opposite direction.

* * * * *